US006217281B1

(12) United States Patent
Jeng et al.

(10) Patent No.: US 6,217,281 B1
(45) Date of Patent: Apr. 17, 2001

(54) LOW-NOISE FAN-FILTER UNIT

(75) Inventors: Ming-Shan Jeng; Ya-Wen Chou; Fang-Hei Tasu; Lai-Fu Chen; Pen-Chang Tseng, all of Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/345,377

(22) Filed: Jun. 30, 1999

(51) Int. Cl.[7] ..... B01D 46/10
(52) U.S. Cl. ..... 415/119; 415/208.2; 454/187
(58) Field of Search ..... 415/119, 121.2, 415/169.1, 206, 208.2, 208.3, 211.2, 225, 226; 454/187; 55/385.2; 181/202, 224, 225

(56) References Cited

U.S. PATENT DOCUMENTS 3,783,969 * 1/1974 Pall ..... 181/33 G
4,410,065 * 10/1983 Harvey ..... 181/224
4,560,395 * 12/1985 Davis ..... 55/276
5,470,363 * 11/1995 Leader et al. ..... 55/276
5,720,274 * 2/1998 Brunner et al. ..... 126/299 D
6,030,186 * 2/2000 Tang ..... 417/312

FOREIGN PATENT DOCUMENTS

406159752 * 6/1994 (JP) ..... 454/187 R
8-86297 * 4/1996 (JP) .
11-37525 * 2/1999 (JP) .

* cited by examiner

*Primary Examiner*—Edward K. Look
*Assistant Examiner*—Liam McDowell
(74) *Attorney, Agent, or Firm*—Birch, Stewart, Kolasch & Birch, LLP

(57) ABSTRACT

A low-noise fan-filter unit for providing filtered airflow is disclosed. The fan-filter unit includes a housing having at least an air inlet and a coaxial air outlet; a centrifugal fan installed in the housing for drawing air into the housing and propelling it out of the air outlet; a filter installed between the fan and the air outlet for removing impurities from the air; and a noise reduction arrangement installed between the fan and the filter for reducing noise. The noise reduction arrangements includes three parting plates incorporating with the housing to form a tortuous air passageway which U-turns the airflow at least two times. The tortuous and extended air passageway, and some sound-absorbing materials furnished along the air passageway increase the contact area between the airflow and the sound-absorbing materials, and enhance the effect of noise absorption.

23 Claims, 10 Drawing Sheets

LOW-NOISE FAN-FILTER UNIT

FIELD OF THE INVENTION

The present invention generally relates to a low-noise fan-filter unit used in a clean room, and particularly relates to a fan-filter unit applicable in a clean room or hospital for providing filtered airflow at pre-defined cleanliness and flow quality. The unit performs at a very low noise level.

BACKGROUND OF THE INVENTION

The fan-filter unit of the invention is an air filtration device incorporating a centrifugal fan and a filter, and provides purified air to the space of a room. Fan-filter units have been widely used in the industry, medical and research facilities. They are especially popular for their characteristics of space-saving, energy-saving and easy installation. However, existing fan-filter units often generate high levels of noise in operation and may psychologically or mentally annoy the personnel within the room where precise and delicate manufacturing processes are being handled. Therefore, there is a need for a clean room fan-filter unit to operate and generate noise at a low level.

A fan-filter unit usually incorporates a centrifugal fan. The airflow drawn into the unit is guided by interior air passageways to the filter in the unit. After passing through the filter, the air is propelled into the designated environment, such as a clean room. The construction of the fan-filter unit makes less space in the axial direction of the fan than in the radial direction. The limited space increases the difficulty of incorporating noise reduction constructions into the fan-filter unit. For example, in a conventional fan-filter unit, for the airflow from the inlet to the outlet, the contact area of the airflow to some sound-absorbing materials is so limited that it performs low effectiveness.

People have been trying to solve the serious problem of the high noise levels of conventional fan-filter units. An exemplary prior art for reducing the noise of a clean room fan-filter unit is disclosed in U.S. Pat. No. 5,803,721. It provides a fan-filter unit having a perforated plate situated within the airflow path in the fan-filter unit housing such that the perforations diffuse the airflow before it passes through a filter and exits the housing. The uniform airflow provided by the perforated plate produces a reduced noise level.

SUMMARY OF THE INVENTION

The primary objective of the present invention is therefore to provide a low-noise fan-filter unit and to reduce the noise influence to the environment.

To achieve the aforesaid objective, a fan-filter unit according to the present invention includes a housing having at least an air inlet and a coaxial air outlet; a centrifugal fan installed in the housing for drawing air from the air inlet into the housing and propelling it out of the air outlet; a filter attached with or inserted into the housing for removing impurities from the air; and noise reduction means installed along the air passageway between the fan and the filter. The housing includes a front wall, a back wall, a right wall, a left wall and an upper wall. The front, back, right and left walls are in the direction parallel to the axis of the fan. The air inlet is on the upper wall. The centrifugal fan is installed in the interior of the housing and positioned under the air inlet. The noise reduction means are installed in the housing along the air passageway between the fan and the filter.

The noise reduction means include at least a tortuous air passageway formed by a flow-guiding plate and a noise-reduction plate, and sound-absorbing materials furnished on walls of the air passageway. The flow-guiding plate is positioned under the fan and extends in the radial direction of the fan. The noise-reduction plate, which can be in one piece or two separate pieces, attaches to the left and right walls of the housing, and extends to the front and the back walls. The position of the noise-reduction plate in the axial direction of the fan is between the flow-guiding plate and the filter. Therefore, the tortuous air passageway is formed among the flow-guiding plate, the noise-reduction plate and the filter. The flow-guiding plate first guides the discharged airflow moving in the radial direction of the fan. The airflow turns into direction parallel to the axial direction of the fan after reaching the walls of the housing. Then, the airflow is further guided by the noise-reduction plate extending inward in the general direction parallel to the radial direction of the fan. And finally, the airflow passes through the opening of the noise-reduction plate, diffuses into the cavity under the noise-reduction plate and exhausts through the filter into a clean environment. Hence, the airflow turns several times in the tortuous air passageway before passing through the filter. The tortuous and extended air passageway, together with the sound-absorbing materials furnished along the air passageway, increases the contact area of the airflow to the sound-absorbing materials, and enhances noise reduction.

An exemplary embodiment of the sound-absorbing materials in the noise reduction means according to the present invention is foam pads furnished on the surface of the air passageway. The foam pads have a wavy or wedged-like surface to absorb noise in the air passageway.

Another exemplary embodiment of the sound-absorbing materials in the noise reduction means according to the present invention is perforated plates mounted along the surface of the air passageway and separated by a clearance with aforementioned plates and walls. Acoustic waves penetrating into the clearance would reflect therein and dissipate into heat, and, thereby, the noise is reduced. Meanwhile, the surfaces of the perforated plates are preferably smooth so that friction losses can be minimized.

For an embodiment of the present invention, in a sectional view taken along a plane parallel to the axis of the fan, the height of the tortuous air passageway should be the same as or close the height at the outlet of the fan, but the opening in or between the noise-reduction plate should be at least twice of the width of the aforementioned height, so that the pressure drop in the air passageway can be minimized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The above objectives and advantages of the present invention will become more apparent from the following detailed descriptions of preferred embodiments with reference to the attached drawings which are given by way in which: of illustration only, and thus are not limitative of the present invention.

DETAILED DESCRIPTION OF PREFERRED EMBODIMENTS

The fan-filter unit according to the present invention substantially includes a rectangular housing, a centrifugal fan installed inside the housing for drawing air into the housing and propelling it out, a filter for removing impurities from the air, and noise reduction means for reducing noise. The noise reduction means further includes several parting plates installed in the interior of the housing and positioned between the fan and the filter. The parting plates incorporate with the housing to form at least a tortuous air passageway which U-turns the airflow at least two times. The tortuous and extended air passageway increases the contact area of the airflow with the sound-absorbing materials, and, thereby, enhances the noise reduction.

Figure 1:
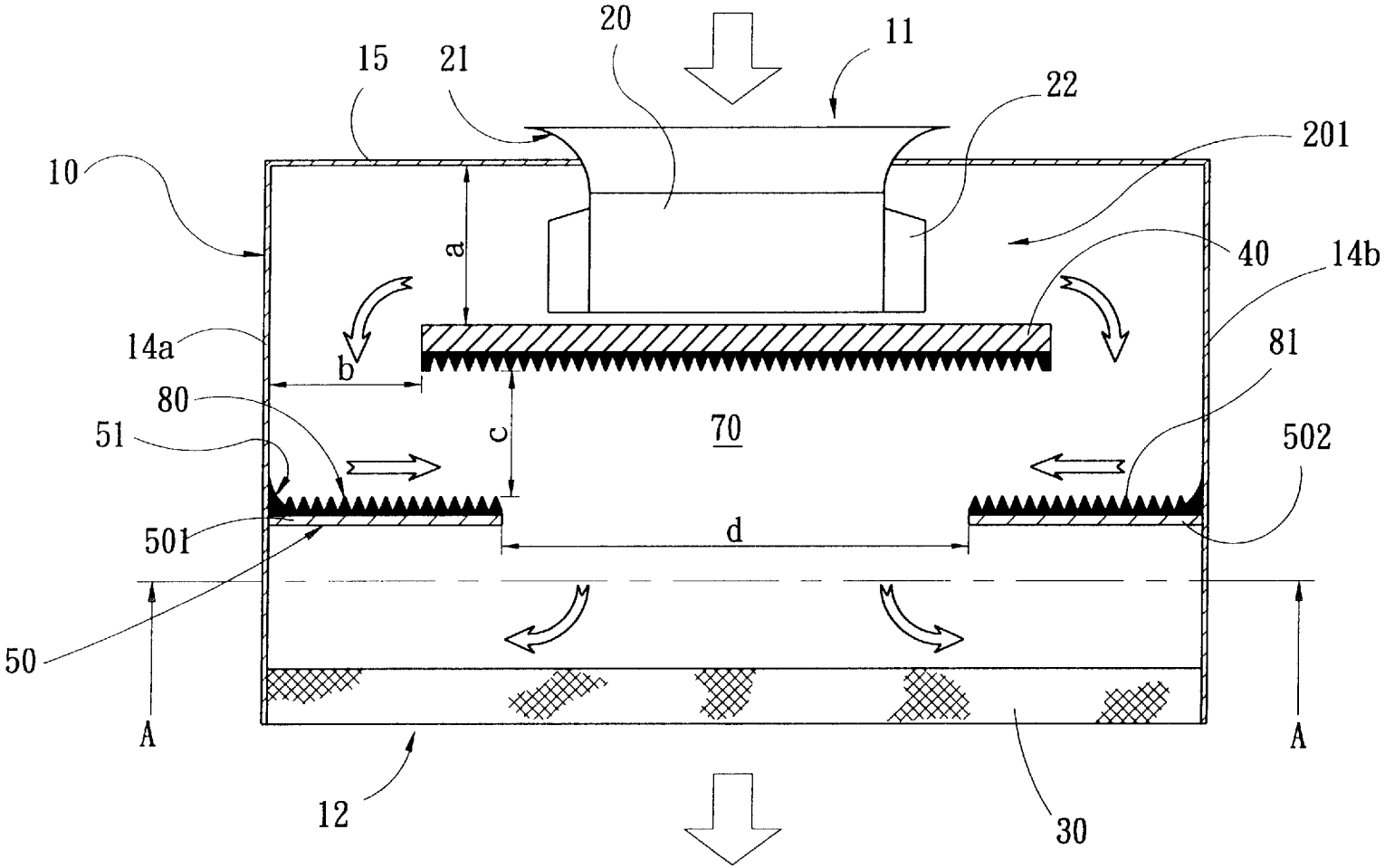
FIG. 1 is a sectional view of the first embodiment of the present invention showing the construction of a fan-filter unit incorporating a housing, a fan, a filter and noise reduction means.

Referring to FIG. 1, a fan-filter unit according to the present invention includes a rectangular hollow housing 10 which has at least an air inlet 11 and a coaxial air outlet 12. A centrifugal fan 20 with blades 22 is installed in the housing 10 and draws air passing through the air inlet 11 into the housing 10, forces the air through a filter 30 and propels it out of the air outlet 12 to a clean environment (such as a clean room). The housing 10 includes a front wall 13*a,* a back wall 13*b,* a left wall 14*a,* a right wall 14*b* and an upper wall 15. The front, back, left and right walls are in the direction parallel to the axis of the fan 20. The air inlet 11 is on the upper wall 15. The centrifugal fan 20 is attached inside the housing 10 and positioned under the air inlet 11. The filter 30 is attached with or inserted in the housing 10. And, the noise reduction means are installed inside the housing 10 creating the air passageway between the fan 20 and the filter 30. A bell mouth 21 can be formed as the air inlet 11 for guiding the air flowing into the housing 10. The filter 30 can be generally made of any filtering media or an air-penetrating meshy material. To enhance the filtration performance, specific filters such as HEPA, ULPA or electrostatic filters, can be used.

The noise reduction means include at least a tortuous air passageway 70 formed by the flow-guiding plate 40, the noise-reduction plate unit 50 having first plate portion 501, second plate portion 502, and sound-absorbing materials 80, 81 furnished on walls of the air passageway 70.

To achieve the noise reduction function, the noise reduction means can be realized as described in the following embodiments.

First embodiment

Figure 2A:
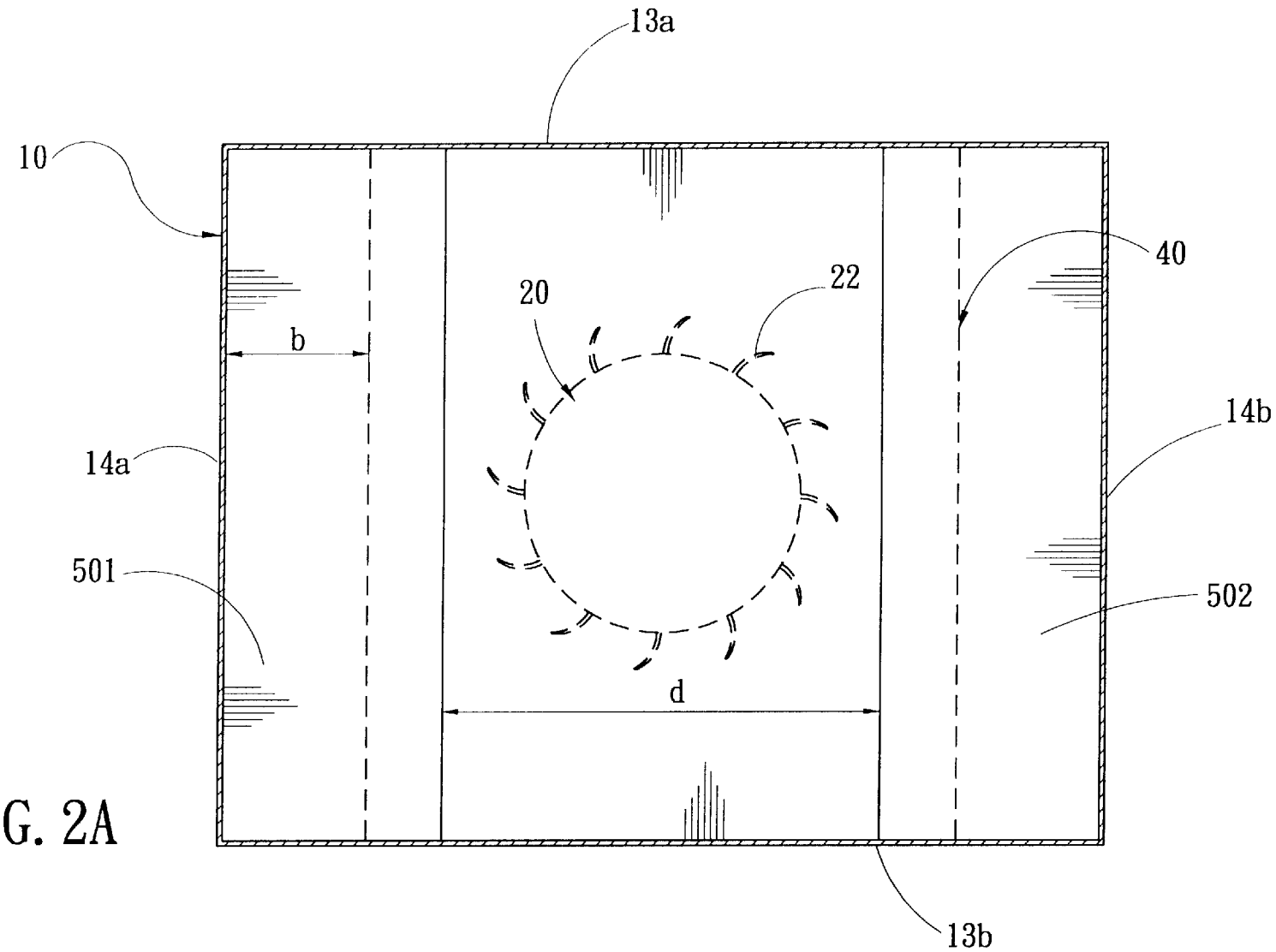
FIG. 2A is a sectional view (A—A) of FIG. 1, showing first exemplary embodiment of the flow-guiding plate.

As shown in FIG. 2A, the flow-guiding plate 40 is positioned under the fan 20, extended in the housing 10 parallel to the radial direction of the fan 20 and between the front and the back walls 13*a,* 13*b*. The noise-reduction plate unit 50 having first plate portion 501 and second plate portion 502 respective attached to the left and right walls 14*a,* 14*b* of the housing 10, extended to the front and the back walls 13*a,* 13*b* and in parallel with the radial direction of the fan 20. The noise-reduction plate unit 50 has an opening between the first plate portion 501 and second plate portion 502. The position of the noise-reduction plate unit 50 in the axial direction of the fan 20 is between the flow-guiding plate 40 and the filter 30. Therefore, the tortuous air passageway 70 are formed by the flow-guiding and noise-reduction plate unit 40, 50, incorporating the front, back, left and right walls 13*a,* 13*b,* 14*a,* and 14*b* of the housing 10.

Figure 2B:
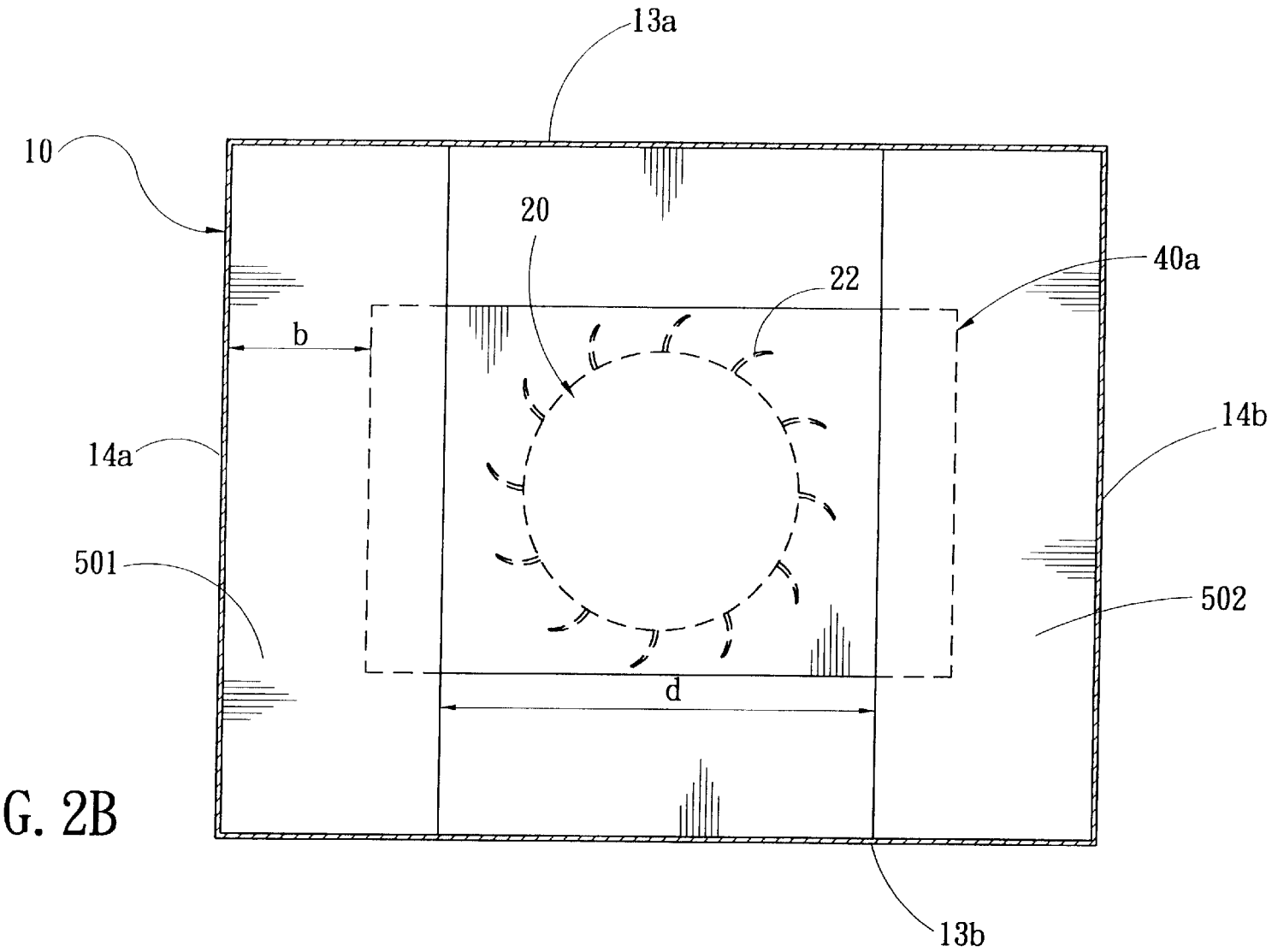
FIG. 2B is a sectional view (A—A) of FIG. 1., showing another exemplary embodiment of the flow-guiding plate.

In the other exemplary embodiment of the flow-guiding plate 40*a* is illustrated in FIG. 2B, wherein the flow-guiding plate 40*a* doesn't contacts any walls of the housing 10, so the air may flow through the flow-guiding plate 40*a* in a direction radial of the fan 20.

Where the first plate portion 501 and second plate portion 502 are attached t0 the left and right walls 14*a,* 14*b,* smooth turning of the airflow, by using rounded corner 51 is preferred.

The sound-absorbing materials 80, shown in FIG. 1, in the noise reduction means according to the present invention are foam pads furnished on the surfaces of the air passageway 70, i.e. on the lower surface of the flow-guiding plate 40, and on the upper surfaces of the noise-reduction plate unit 50. The sound-absorbing materials 80 preferably have wavy or wedge-like surfaces 81 for better sound-absorbing performance.

The airflow through the fan 20 outlet is first guided by the flow-guiding plate 40 to move in radial direction of the fan 20 in the housing 10. Then, the airflow turns into the direction parallel to the axial direction of the fan 20. Then, the airflow is further guided by the noise-reduction plate unit 50 in the direction generally parallel to the radial direction of the fan 20 (the airflow makes a first U-turn here). And finally, the airflow passes through the opening "d" formed in or between the noise-reduction plate 50, diffuses into the cavity under the noise-reduction plate 50 (the airflow makes a second U-turn here) and exhausts through the filter 30.

Second embodiment

Figure 3:
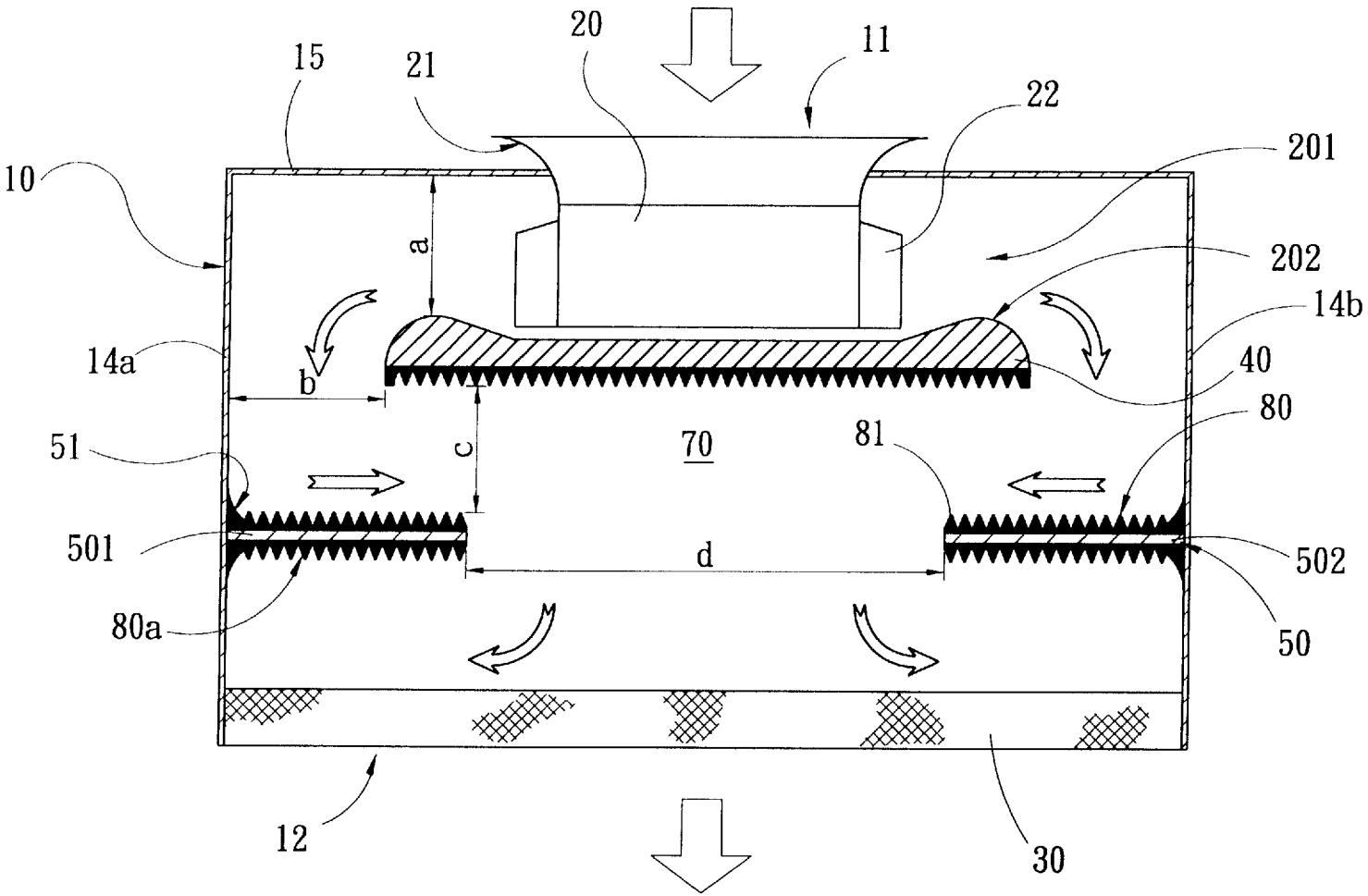
FIG. 3 is a sectional view of the second embodiment of the present invention based on FIG. 1.

FIG. 3 shows a second embodiment of the present invention in which the noise reduction means are modified by the embodiment of FIG. 1. Two curvy extrusions 202 are formed on two edges of the flow-guiding plate 40. The extrusions 202 contract the output ports 201 of the fan 20 to guide the output airflow flowing in parallel with the upper wall 15 of the housing 10 and to increase the velocity of the airflow. The edges of the extrusions 201 turn into the vertical direction which is parallel to the side walls 14*a,* 14*b* of the housing 10 so as to guide the airflow turning into the direction parallel to the axis of the fan 20.

Another modification is to provide sound-absorbing materials 80*a* on the lower surfaces of the noise-reduction plate unit 50. When the airflow passing through the opening "d" between the noise-reduction plate unit 50, a part of the airflow will move tinder the lower surfaces of the noise-reduction plate unit 50 before exiting through the filter 30, therefore, a further reduction of the noise can be obtained.

Third embodiment

Figure 4:
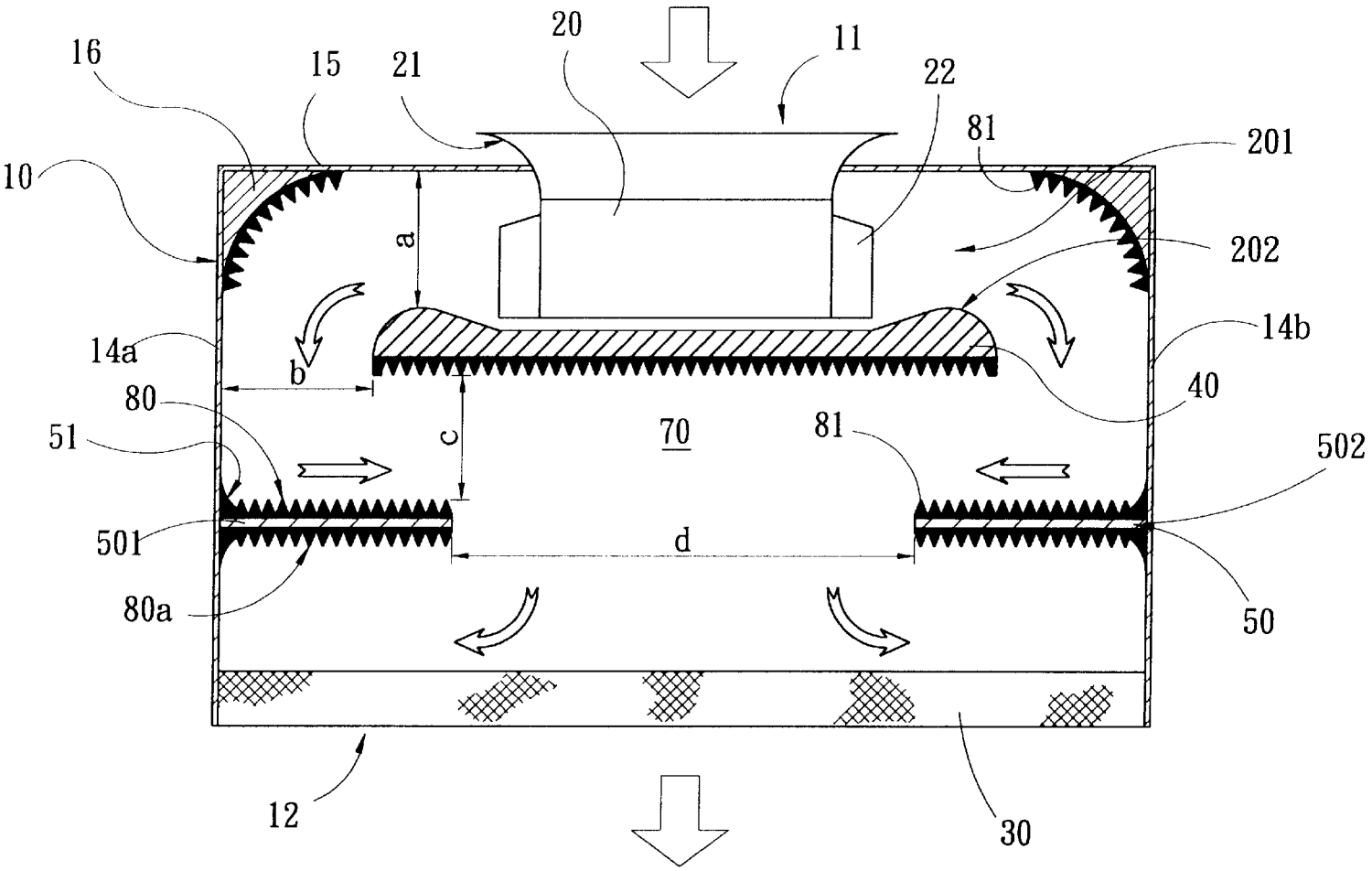
FIG. 4 is a sectional view of the third embodiment of the present invention further based on FIG. 1.

FIG. 4 shows a third embodiment of the present invention in which the noise reduction means was modified by the embodiment of FIG. 3. The modification is to furnish each corner of the air passageway with a rounded corner. For example, in the corners of the upper wall 15 of the housing 10 to the left and right walls 14*a,* 14*b,* curvy corners 16 are formed and furnished with sound-absorbing materials 80 so as to smooth the airflow when it turns in the air passageway and to further reduce the noise.

Further embodiments

Figure 5:
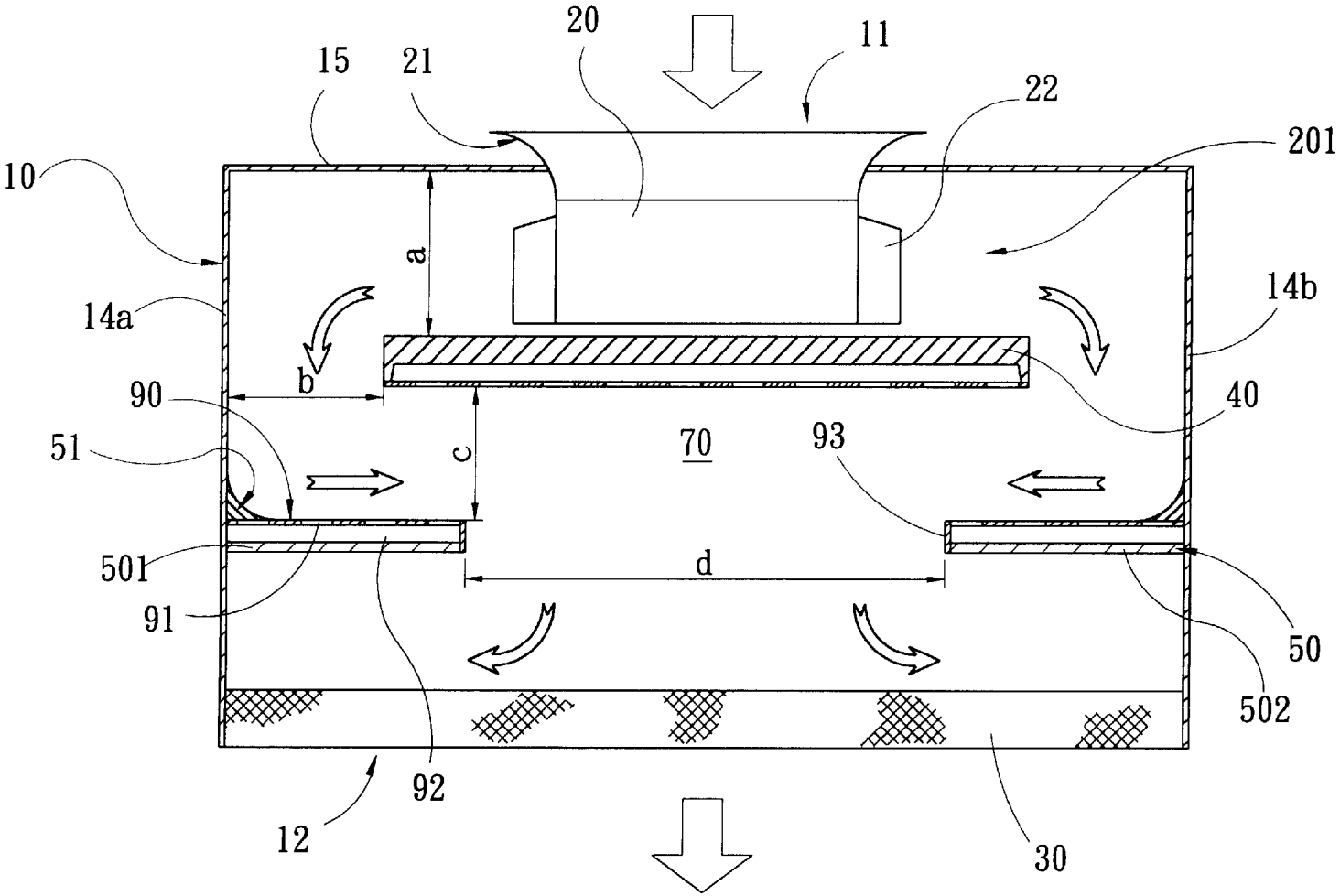
FIG. 5 is a sectional view of the fourth embodiment of the present invention, showing an example of using perforated plates as sound-absorbing materials.
Figure 6:
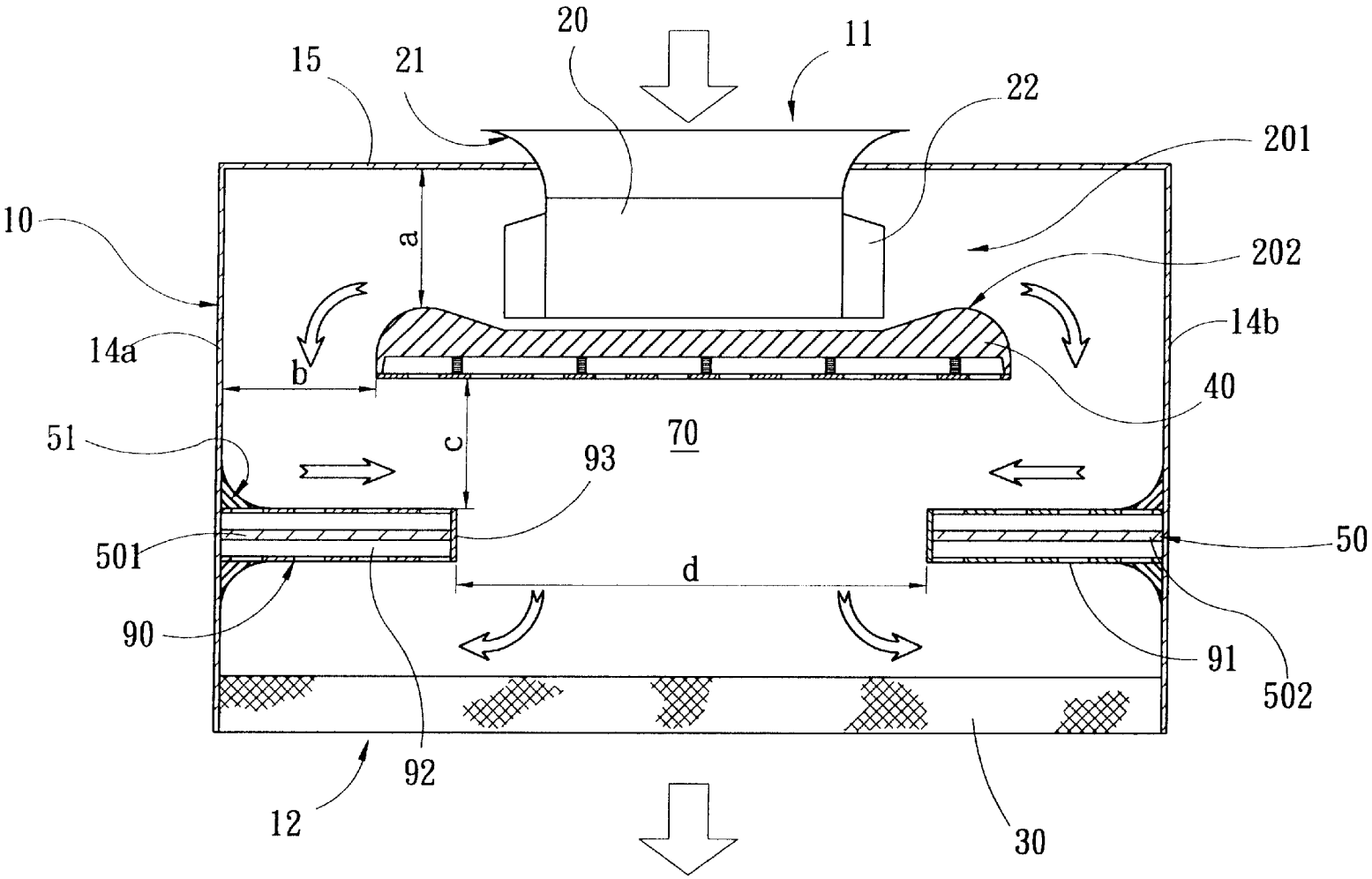
FIG. 6 is a sectional view of the fifth embodiment of the present invention based on FIG. 5.
Figure 7:
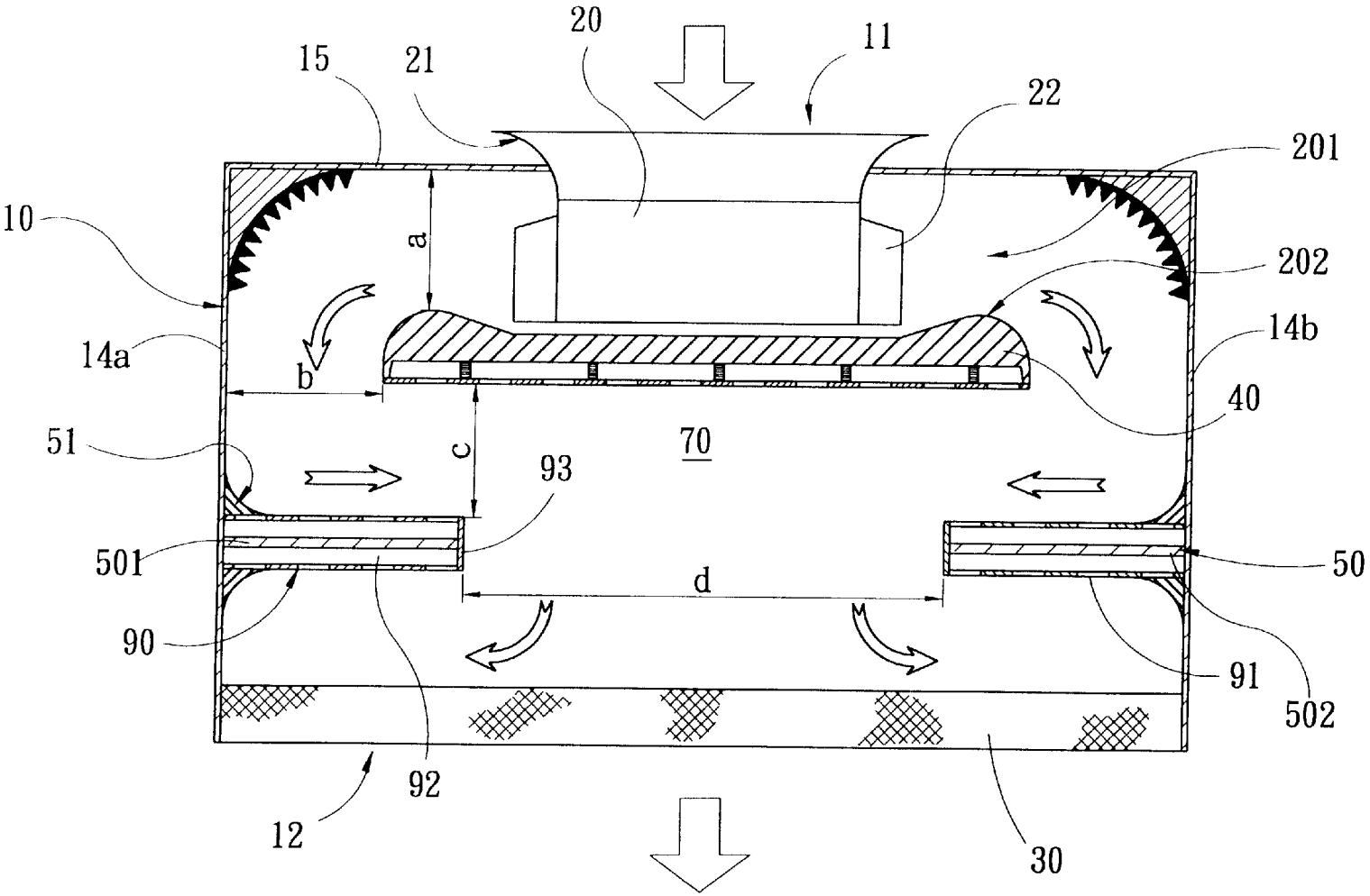
FIG. 7 is a sectional view of the sixth embodiment of the present invention further based on FIG. 5.

FIGS. 5 to 7 illustrates respectively a fourth, a fifth and a sixth embodiment of the present invention in which the noise reduction means are similar to the embodiments of FIG. 1, 3 and 4 but different in the sound-absorbing materials 80. The sound-absorbing materials used in these embodiments are perforated plates 90, which are furnished with a plurality of penetrating holes 91. The perforated plates 90 are mounted above the parting plates. There are clearances 92 formed between the perforated plates 90 and the parting plates 40, 50 of the air passageway 70. A preferred manner is to form some supporting elements 93 on the edges of the perforated plates 90 to maintain a suitable clearance between the perforated plates 90 and the plates 40, 50. The clearances are preferably less than a quarter of the wavelength of the acoustic wave so that the acoustic wave penetrating through the holes 91 into the clearances will reflect therein and dissipate into heat, and the noise is reduced.

Meanwhile, the surfaces of the perforated plates 90 are preferably smooth so that frictional loss of the airflow can be minimized due to the low friction of the airflow moving along the perforated plates 90 of the air passageway 70.

Basically, in the aforesaid embodiments, the width "b" of the tortuous air passageway 70 is preferred of the same as the width "a" of the output port 201 of the fan 20. While, since the fan 20 provides two radial airflow outputs to the air passageway 70 which combine into one before passing the filter 30, the width of the air passageway 70 before the filter 30, i.e. the opening "d" formed between the noise-reduction plate unit 50 should be at least twice of the width "a" of the output port 201 of the fan 20, so that the pressure drop in the air passageway 70 can be minimized.

Figure 8:
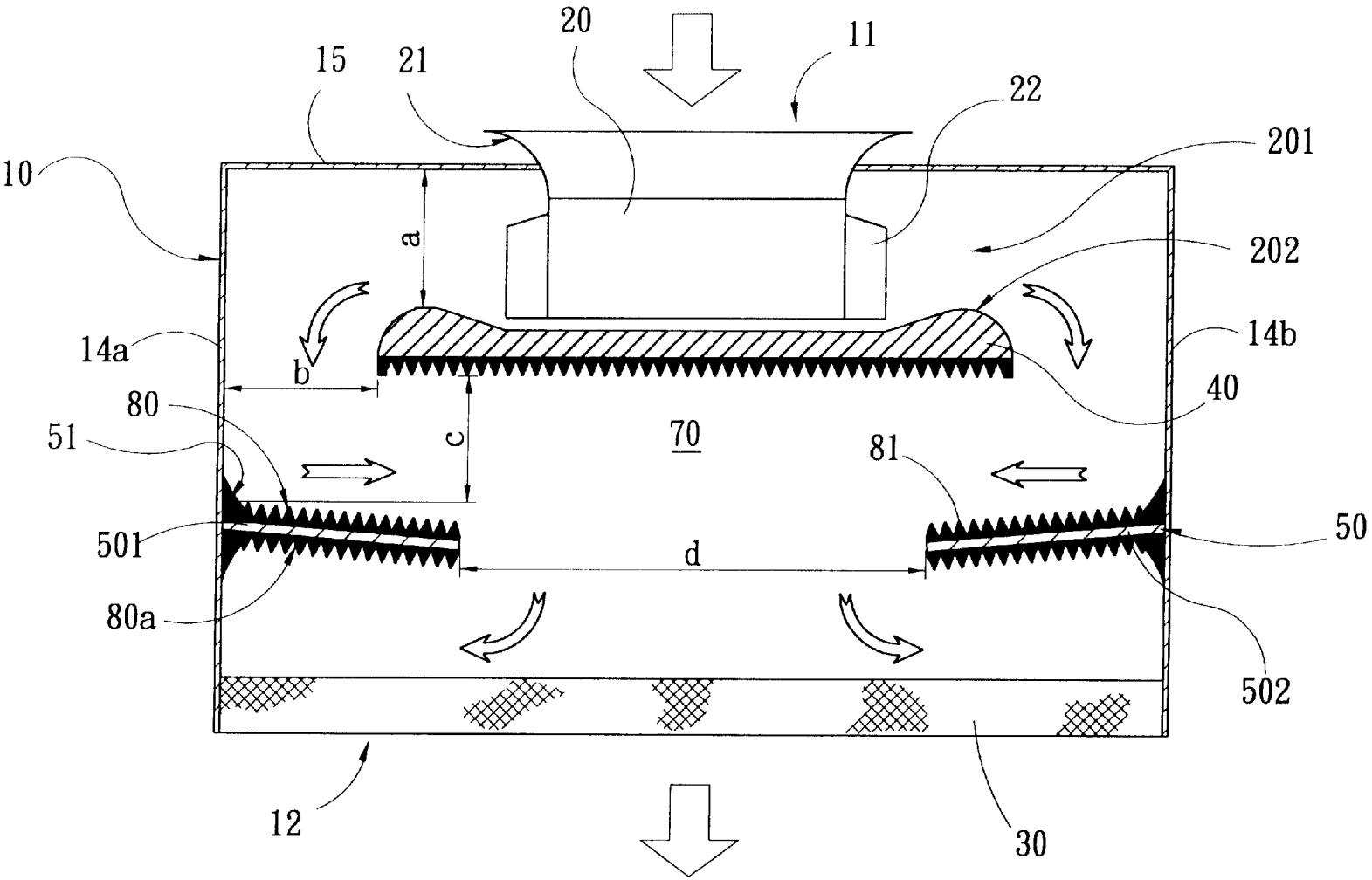
FIG. 8 is a sectional view of the seventh embodiment of the present invention, showing another exemplary embodiment of the noise-reduction plate.
Figure 9:
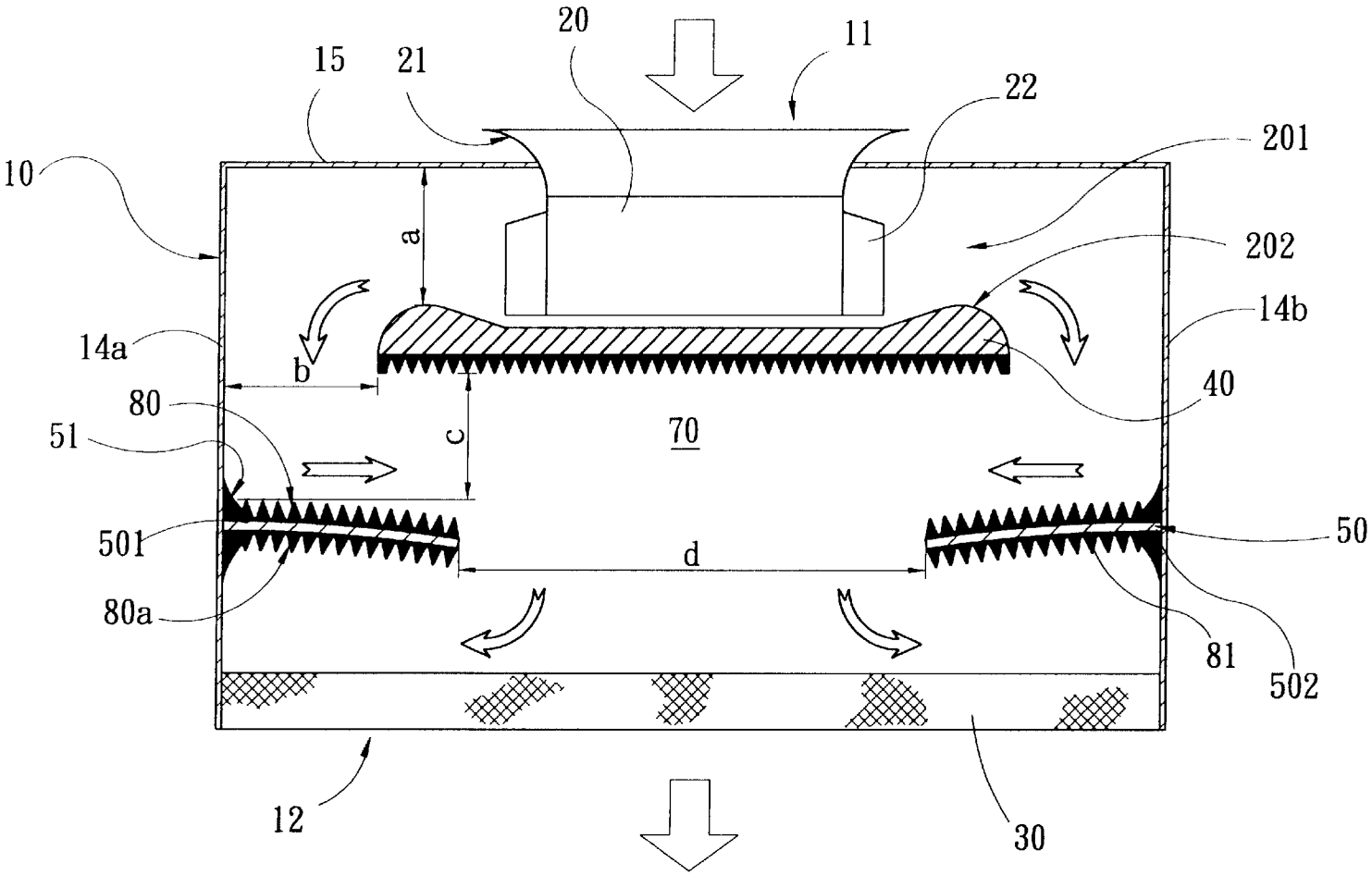
FIG. 9 is a sectional view of the eighth embodiment of the present invention, showing further another exemplary embodiment of the noise-reduction plate.

As for the arrangement of the noise-reduction plate unit 50, it can be in parallel with the upper wall 15 of the housing 10 as shown in FIG. 1; or incline from the left and right walls 14*a,* 14*b* toward the filter 30 as shown in FIG. 8; or even bend down from the left and right walls 14*a,* 14*b* toward the filter 30 as shown in FIG. 9, so that a suitable airflow performance can be achieved. But substantially, the pressure drop of the air passageway should not be increased. So, the minimum width "c" of the air passageway between the flow-guiding plate 40 and the noise-reduction plate unit 50 should not less than the width "a" of the output port 201 of the fan 20.

The housing 10 has to be made from sound retarding materials, and furnished with sound-absorbing materials on the surface thereof, so as to prevent noise transmission from the housing 10 to the exterior.

The advantage of the present invention is that the parting plates and the sound-absorbing materials make the fan-filter unit a lower noise device. In the lower noise fan-filter unit, the airflow makes at least two U-turns in the tortuous air passageway before passing through the filter. The tortuous and extended air passageway and the sound-absorbing materials furnished along the air passageway increase the contact area between the airflow and the sound-absorbing materials, and enhance the effect of noise reduction.

It is to be understood that the drawings are designed for purposes of illustration only, and are not intended as a definition of the limits and scope of the invention disclosed.

What is claimed is:

1. A low-noise fan-filter unit for providing filtered air into a clean room, comprising:

a rectangular hollow housing having an air inlet formed on a first wall thereof and an air outlet formed on a second wall opposite to said first wall, side walls being provided between the first and second walls;

a fan, installed in said housing and near said air inlet, for drawing air through said air inlet into said housing;

a filter, installed in said housing and positioned between said fan and said air outlet, for removing impurities from the air flowing through said housing;

a flow-guiding plate, installed in said housing and positioned under said fan, for turning the direction of said air drawn through said inlet, the flow-guiding plate having a top surface and a bottom surface and the flow-guiding plate having a curvy extension formed around an edge thereof, the curvy extension being on the top surface of the flow-guiding plates facing the fan, the curvy extension terminating before the bottom surface of the flow-guiding plate with edges at ends of the curvy extension being vertical and generally parallel to at least one of the side walls of the housing;

a noise-reduction plate unit having a first plate portion and a second plate portion respectively, installed in said housing and positioned between said flow-guiding plate and said filter, so as to form a tortuous air passageway among said flow-guiding plate, noise-reduction plate and said filter; and sound-absorbing materials furnished along said air passageway for reducing the noise of the air flowing through said passageway.

2. The low-noise fan-filter unit as recited in claim 1 wherein the air inlet comprises a bell mouth for guiding air into the fan-filter unit.

3. The low-noise fan-filter unit as recited in claim 1 wherein the flow-guiding plate front extends in said housing parallel to a radial direction of the fan and between the two opposite walls of said housing.

4. The low-noise fan-filter unit as recited in claim 1 wherein the flow-guiding plate front fails to contact the side walls of said housing, and allows the airflow around said flow-guiding plate in a radial direction of said fan.

5. The low-noise fan-filter unit as recited in claim 1 wherein the flow-guiding and the noise-reduction plate unit are parallel with each other.

6. The low-noise fan-filter unit as recited in claim 1 wherein the flow-guiding and the noise-reduction plate unit are not parallel with each other.

7. The low-noise fan-filter unit as recited in claim 1 wherein the noise-reduction plate is a curvy plate bending toward the filter.

8. The low-noise fan-filter unit as recited in claim 1 wherein the cross-sectional area of the air passageway at least downstream of the flow-guiding plate remains equal so that airflow would not have excessive acceleration or deceleration.

9. The low-noise fan-filter unit as recited in claim 1 wherein the sound-absorbing materials are further furnished on the surface of the noise-reduction plate unit facing the filter to enhance noise reduction.

10. The low-noise fan-filter unit as recited in claim 2 wherein the sound-absorbing materials are further furnished on the surface of the noise-reduction plate unit facing the filter to enhance noise reduction.

11. The low-noise fan-filter unit as recited in claim 8 wherein the sound-absorbing materials are further furnished on the surface of the noise-reduction plate unit facing the filter to enhance noise reduction.

12. The low-noise fan-filter unit as recited in claim 1 wherein the sound-absorbing materials are further furnished on the surface of the noise-reduction plate unit facing the air outlet.

13. The low-noise fan-filter unit as recited in claim 1 wherein rounded corners are formed at least at one corner in the air passageway.

14. The low-noise fan-filter unit as recited in claim 1 wherein rounded corners are formed at the corners in the air passageway.

15. The low-noise fan-filter unit as recited in claim 13 wherein surfaces of the rounded corners are furnished with sound-absorbing materials.

16. The low-noise fan-filter unit as recited in claim 1 wherein rounded corners are formed at each corner in the air passageway so as to make the airflow turn smoothly in the passageway.

17. The low-noise fan-filter unit as recited in claim 1 wherein the sound-absorbing materials are foam pads.

18. The low-noise fan-filter unit as recited in claim 17 wherein the sound-absorbing materials are foam pads with wavy or wedge-like sound-absorbing surfaces.

19. The low-noise fan-filter unit as recited in claim 1 wherein the sound-absorbing materials are perforated plates having multiple penetrating holes formed thereon, and air clearances are created between said perforated plates and surfaces of the air passageway.

20. The low-noise fan-filter unit as recited in claim 1 wherein the filter is an air-penetrating meshy material.

21. The low-noise fan-filter as recited in claim 1 wherein the bottom-surface of the flow-guiding plate is generally flat and wherein sound-absorbing materials are provided on the bottom-surface of the flow-guiding plate.

22. The low-noise fan-filter as recited in claim 1 wherein a minimum distance between a top of the curvy extension and the first wall of the housing equals a distance between a side of the flow-guiding plate and an adjacent side wall of the housing.

23. The low-noise fan-filter as recited in claim 22 wherein the distance between the side of the flow-guiding plate and the adjacent side wall of the housing equals a distance between overlapping portions of the bottom surface of the flow-guiding plate with any sound-absorbing materials and a top surface of the noise-reduction plate unit with any sound-absorbing materials thereon.

* * * * *